US010056176B2

(12) United States Patent
Wang et al.

(10) Patent No.: US 10,056,176 B2
(45) Date of Patent: Aug. 21, 2018

(54) OVER-CURRENT PROTECTION DEVICE

(71) Applicant: Polytronics Technology Corp., Hsinchu (TW)

(72) Inventors: David Shau Chew Wang, Taipei (TW); Chun Teng Tseng, Sanwan Township, Miaoli County (TW); Tsungmin Su, Hsinchu (TW); Yao Te Chang, Linnei Township, Yunlin County (TW)

(73) Assignee: Polytronics Technology Corp., Hsinchu (TW)

( * ) Notice: Subject to any disclaimer, the term of this patent is extended or adjusted under 35 U.S.C. 154(b) by 158 days.

(21) Appl. No.: 15/156,813

(22) Filed: May 17, 2016

(65) Prior Publication Data

US 2017/0018339 A1 Jan. 19, 2017

(30) Foreign Application Priority Data

Jul. 16, 2015 (TW) ..... 104123004 A

(51) Int. Cl.
*H01C 7/02* (2006.01)

(52) U.S. Cl.
CPC ..... *H01C 7/021* (2013.01); *H01C 7/027* (2013.01)

(58) Field of Classification Search
CPC ..... H01C 7/021; H01C 7/027
USPC ..... 338/22 R
See application file for complete search history.

(56) References Cited

U.S. PATENT DOCUMENTS 4,668,857 A * 5/1987 Smuckler ..... H01C 7/027 219/549
7,286,038 B1 * 10/2007 Wang ..... H01C 1/084 252/512
8,461,956 B2 * 6/2013 Tseng ..... H01C 1/1413 337/102

(Continued)

FOREIGN PATENT DOCUMENTS

TW 465159 B 11/2001
TW 478231 B 3/2002

(Continued)

*Primary Examiner* — Kyung Lee
*Assistant Examiner* — Iman Malakooti
(74) *Attorney, Agent, or Firm* — Muncy, Geissler, Olds & Lowe, P.C.

(57) ABSTRACT

An over-current protection device comprises a PTC device and a heating element operable to heat the PTC device. The PTC device contains crystalline polymer and metal or ceramic conductive filler dispersed therein. The PTC device has a resistivity less than 0.1 Ω·cm. The over-current protection device has the relation: It (heating)<Ih (60° C.)× 10%, where Ih (60° C.) is a hold current of the over-current protection device at 60° C. when the heating element is not activated; It (heating) is a trip current of the over-current protection device when the heating element is activated to heat the PTC device. The PTC device has high hold current, thereby allowing a battery containing the device can be fast charged with a large current. In a specific situation, the heating element heats the PTC device to decrease the hold current of the over-current protection device of low resistivity, and accordingly the PTC device can trip by a small current.

17 Claims, 11 Drawing Sheets

(56) References Cited

U.S. PATENT DOCUMENTS

| | | | | |
|---|---|---|---|---|
| 2002/0070842 | A1* | 6/2002 | Heaney | H01C 1/1406<br>338/22 R |
| 2013/0249868 | A1* | 9/2013 | Li | H02H 9/026<br>345/177 |
| 2014/0091896 | A1* | 4/2014 | Wang | H01C 1/08<br>338/22 R |
| 2014/0118871 | A1* | 5/2014 | Tseng | H01C 17/00<br>361/58 |

FOREIGN PATENT DOCUMENTS

| | | |
|---|---|---|
| TW | M284178 U | 12/2005 |
| TW | I358071 | 2/2012 |

* cited by examiner

OVER-CURRENT PROTECTION DEVICE

BACKGROUND OF THE INVENTION (1) Field of the Invention

The present application relates to an over-current protection device and, and more specifically, to an over-current protection device with protection by tripping a positive temperature coefficient (PTC) device.

(2) Description of the Related Art

Over-current protection devices are used for circuit protections to prevent circuits from being damaged due to over-current or over-temperature events. An over-current protection device usually contains two electrodes and a resistive material disposed therebetween. The resistive material has PTC characteristic; that is, the resistance of the PTC material remains extremely low at a normal temperature; however when an over-current or an over-temperature occurs in the circuit, the resistance instantaneously increases to a high resistance state (i.e., trip) to diminish the current for circuit protection. When the temperature decreases to room temperature or over-current no longer exists, the over-current protection device returns to low resistance state so that the circuit operates normally again. Because the PTC over-current protection devices can be reused, they can replace fuses and are widely applied to high-density circuitries.

In general, the PTC conductive composite material contains crystalline polymer and conductive filler. The conductive filler is dispersed uniformly in the crystalline polymer. The crystalline polymer is usually a polyolefin polymer such as polyethylene. The conductive filler usually contains carbon black powder. However, carbon black exhibits low electrical conductivity and therefore is unsatisfactory to the demands of low resistivity applications. Therefore, a PTC conductive composite material containing a conductive filler of low resistivity such as metal or conductive ceramic filler is devised to obtain lower resistivity than a material containing carbon black, so as to develop a so-called low-rho over-current protection device.

In battery quick charge applications, a PTC device has to have a high hold current from a room temperature to 60° C., allowing quick charge to a battery with a large current even if the temperature goes up to 60° C. In such a case, for example, an action that needs one hour normal charge can speed up to 20 minutes by quick charge. Quick charge needs to comply with specific safety specifications. The PTC device has to rapidly sever a charging current to protect the battery when over-charge, instantaneous voltage change, over-voltage, or over-temperature occurs. At ambient temperature of 80° C., the PTC device has to trip within 60 seconds when a current of 8 amperes is applied thereto, thereby effectively providing over-current protection to relevant circuits or apparatuses.

SUMMARY OF THE INVENTION

To resolve the problem that the over-current protection device of low resistivity is not easily tripped at a specific temperature, the present application devised an over-current protection device in which a heating element is embedded therein to speed up trip of the PTC device of low resistivity so as to effectively provide over-current protection.

In accordance with a first embodiment of the present application, an over-current protection device comprises at least one PTC device and at least one heating element. In an exemplary embodiment, the PTC device and the heating element are stacked. The PTC device contains crystalline polymer and metal or ceramic conductive filler dispersed therein. The PTC device is the so-called low-rho PTC device having a volume resistivity less than 0.1 Ω·cm, or 0.05 Ω·cm. The heating element is operable to heat the PTC device. The over-current protection device has the relation: It (heating)<Ih (60° C.)×10%, where Ih (60° C.) is a hold current of the over-current protection device at 60° C. when the heating element is not activated; It (heating) is a trip current of the over-current protection device when the heating element is activated to heat the PTC device. The heating element has a resistance sufficient to effectively heat up the PTC device to decrease the hold current of the PTC device to induce trip. In an exemplary embodiment, the heating element has a resistance sufficient to induce trip within 60 seconds when a current of 8 amperes is applied to the PTC device at ambient temperature of 80° C. Preferably, the heating element has a resistance larger than or equal to 0.1Ω.

In an exemplary embodiment, the heating element may connect to a switch to receive a signal from a sensor. When the sensor detects a voltage drop in the circuit or a temperature exceeds to a threshold value, the switch turns on to allow a current flowing through the heating element to heat up the PTC device.

In an exemplary embodiment, the heating element may contain a circuit of two resistors in serial connection to increase efficiency of the heating element.

In an exemplary embodiment, the PTC device contains crystalline polymer of a melting point greater than 150° C. for high temperature applications. For example, the crystalline polymer comprises polyvinylidene difluoride (PVDF).

In an exemplary embodiment, the heating element may be a ceramic PTC heater, a polymeric PTC heater element or a traditional resistor-type heater. A polymeric PTC heater may comprise polymer of a melting point greater than 150° C., e.g., PVDF, for high temperature applications.

In an exemplary embodiment, the heating element of the over-current protection device is disposed between two PTC devices, and those two PTC devices are in parallel connection.

In an exemplary embodiment, two ends of the PTC device electrically connect to a first electrode and a second electrode, and two ends of the heating element electrically connect to a third electrode and a fourth electrode. The first, second, third and fourth electrodes are formed at a lower surface of the over-current protection device as interfaces for surface-mounting to a circuit board. In such a case, the PTC device and the heating element have no common electrode.

In an exemplary embodiment, two ends of the PTC device electrically connect to a first electrode and a second electrode, and two ends of the heating element electrically connect to the second electrode and a third electrode. The first, second and third electrodes are formed at a lower surface of the over-current protection device as interfaces for surface-mounting to a circuit board. Accordingly, the PTC device and the heating element use a common electrode, i.e., the second electrode.

In an exemplary embodiment, the PTC device comprises a PTC material layer, a first metal foil and a second metal foil. The first metal foil is formed on an upper surface of the PTC material layer, whereas the second metal foil is formed on a lower surface of the PTC material layer. The heating element comprises a heating layer, a first conductive layer and a second conductive layer. The first conductive layer is formed on an upper surface of the heating layer, and the second conductive layer is formed on a lower surface of the heating layer. On a structural basis of the PTC device and heating element design, in an embodiment, the first electrode electrically connects to the first metal foil, the second electrode electrically connects to the second metal foil and the first conductive layer, and the third electrode electrically connects to the second conductive layer. The first, second and third electrodes are formed at a lower surface of the over-current protection device as interfaces for surface-mounting. A first conductive connecting member extends vertically to connect to the first electrode and the first metal foil. A second conductive connecting member extends vertically to connect to the second electrode, the second metal foil and the first conductive layer. At least one conductive hole extends vertically to connect to the third electrode and the second conductive layer. Both the first and second conductive layers are separated from the first conductive connecting member. In another embodiment, the first electrode electrically connects to the first metal foil, the second electrode electrically connects to the second metal foil, the third electrode electrically connects to the first conductive layer, and the fourth electrode electrically connects to the second conductive layer. The first, second, third and fourth electrodes are formed at a lower surface of the over-current protection device as interfaces for surface-mounting. A first conductive connecting member extends vertically to connect to the first electrode and the first metal foil. A second conductive connecting member extends vertically to connect to the second electrode and the second metal foil. A third conductive connecting member extends vertically to connect to the third electrode and the first conductive layer. A fourth conductive connecting member extends vertically to connect to the fourth electrode and the second conductive layer. Both the first and second conductive layers are separated from the first and second conductive connecting members.

In an exemplary embodiment, the PTC device comprises a PTC material layer, a first metal foil and a second metal foil. The first metal foil is formed on an upper surface of the PTC material layer, whereas the second metal foil is formed on a lower surface of the PTC material layer. The heating element comprises a heating layer, a first conductive layer, a second conductive layer and a third conductive layer. The first conductive layer is formed on an upper surface of the heating layer, and the second and third conductive layers are formed on a lower surface of the heating layer. On a structural basis of the PTC device and heating element design, in an embodiment, the first electrode electrically connects to the first metal foil, the second electrode electrically connects to the second metal foil, the third electrode electrically connects to the second conductive layer, and the fourth electrode electrically connects to the third conductive layer. The first, second, third and fourth electrodes are formed at a lower surface of the over-current protection device as interfaces for surface-mounting. A first conductive connecting member extends vertically to connect to the first electrode and the first metal foil. A second conductive connecting member extends vertically to connect to the second electrode and the second metal foil. At least one first conductive hole extends vertically to connect to the third electrode and the second conductive layer. At least one second conductive hole extends vertically to connect to the fourth electrode and the third conductive layer. The second conductive layer is separated from the third conductive layer, and the first, second and third conductive layers are separated from the first and second conductive connecting members.

The over-current protection device of the present application sustains high hold current at a specific temperature, e.g., 60° C., allowing to conduct quick charge with a large current. When a voltage drop in a circuit or an ambient temperature exceeds a threshold value, the heating element is activated to heat the PTC device. Accordingly, the hold current of the PTC device decreases so as to induce or accelerate trip of the PTC device. The over-current protection device of the present application has low resistivity, high hold current and meets safety criteria of trip within 60 seconds when a current of 8 amperes (8 A) is applied thereto, and therefore it is suitable for low-rho PTC applications.

BRIEF DESCRIPTION OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1A:
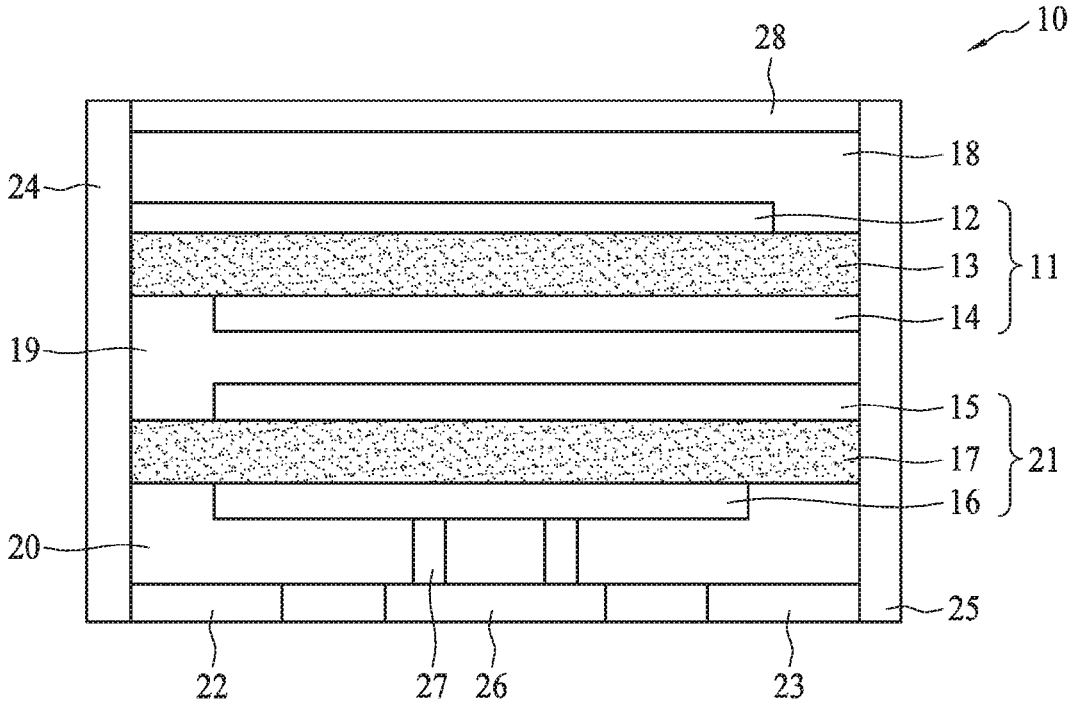
FIGS. 1A to 1C show an over-current protection device in accordance with a first embodiment of the present application.
Figure 1B:
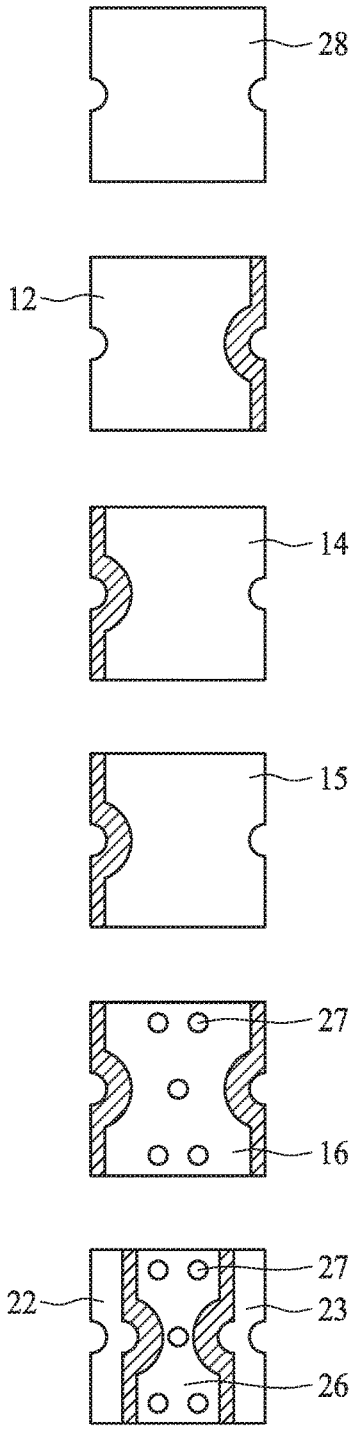

FIGS. 1A and 1B show an over-current protection device 10 which is a hexahedron that could be used for surface-mounting. FIG. 1A is a lateral view of the over-current protection device 10 illustrating essential structures and conductive paths. The over-current protection device 10 is a laminated structure comprising conductive layers, insulating layers and at least one PTC material layer extending in a horizontal direction, those layers associating with vertical conductive connecting members to constitute a circuitry as desired. For the ease of describing the circuitry, upper and lower surfaces of the over-current protection device 10, and individual conductive layers are shown in FIG. 1B. The shadow parts are notches those are removed by etching in circuitry manufacturing for separation. The core of the over-current protection device 10 comprises a PTC device 11 and a heating element 21. The PTC device 11 comprises a PTC material layer 13, a first metal foil 12 and a second metal foil 14. The first metal foil 12 and the second metal foil 14 are formed on upper and lower surfaces of the PTC material layer 13, respectively. The heating element 21 may be a ceramic PTC heater or polymeric PTC heater, or may be a traditional resistor heater with a certain resistance. In an embodiment, the heating element 21 has a resistance greater than 0.1Ω or 0.2Ω. In an embodiment, the heating element 21 comprises a heating layer 17, a first conductive layer 15 and a second conductive layer 16. The first conductive layer 15 and the second conductive layer 16 are formed on upper and lower surface of the heating layer 17, respectively. Insulating layers 18, 19 and 20 are disposed on or between the PTC device 11 and the heating element 12, and may contain prepreg or other insulating materials. An upper surface of the insulating layer 18 is provided with a solder mask 28, and a lower surface of the insulating layer 20 is provided with a first electrode 22, a second electrode 23 and a third electrode 26. The third electrode 26 is disposed between the first electrode 22 and second electrode 23, and gaps are formed therebetween for separation. The first metal foil 12 of the first PTC device 11 electrically connects to the first electrode 22 through a first conductive connecting member 24 extending in a vertical direction. The second metal foil 14 electrically connects to the second electrode 23 through a second conductive connecting member 25 extending in a vertical direction. In an embodiment, the first and second conductive connecting members 24 and 25 may be semicircular holes made by mechanical drilling followed by electroplating conductive films thereon. The first conductive layer 15 on the heating layer 17 electrically connects to the second electrode 23 through the second conductive connecting member 25, whereas the second conductive layer 16 electrically connects to the third electrode 26 through conductive holes 27.

The PTC material layer 13 may comprise crystalline polymer and metal or conductive ceramic fillers dispersed therein, and accordingly has low resistivity. Because the use of conductive filler of low resistivity, the resistivity of the PTC device 11 could be less than 0 Ω·cm, or 0.05 Ω·cm. The crystalline polymer of the PTC material layer 13 may include polyolefin such as high density polyethylene (HDPE) and low density polyethylene (LDPE). The crystalline polymer may completely or partially contain crystalline polymer of a high melting point, e.g., >150° C., for example, polyvinylidene fluoride (PVDF), polyvinyl fluoride (PVF), polytetrafluoroethylene (PTFE), polychlorotrifluoro-ethylene (PCTFE), so as to increase the melting point of the PTC material layer 13 for high-temperature applications. The metal or conductive ceramic filler may comprise nickel, cobalt, copper, iron, tin, lead, silver, gold, platinum, titanium carbide, tungsten carbide, vanadium carbide, zirconium carbide, niobium boride, tantalum carbide, molybdenum carbide, hafnium carbide, titanium boride, vanadium boride, zirconium boride, niobium boride, molybdenum boride, hafnium boride, zirconium nitride, and combinations thereof, e.g., mixture, solid solution or core-shell.

In an embodiment, if the heating element 21 is a polymeric PTC device, the polymer may comprise PVDF, PVF, PTFE or PCTFE of which a melting point greater than 150° C. for high-temperature applications. In particular, the resistivity of the heating element 21, in which carbon black may be used as conductive filler, is greater than that of the PTC device 11. As such, when over-voltage and over-temperature is detected by voltage or temperature sensors, a switch turns on to allow current to flow through the heating element 21. The heating element 21 has high resistivity, and therefore it can heat up rapidly to heat the PTC device 11 effectively. To meet the criteria of quick charge, the over-current protection device 10 can trip within 60 seconds at ambient temperature of 80° C. when a current of 8 A is applied thereto.

Figure 1C:
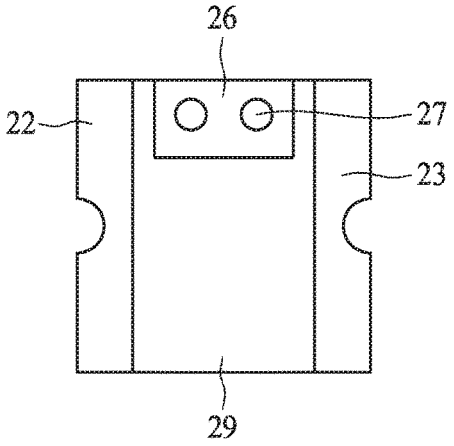

In an embodiment, a solder mask 29 may be formed on a lower surface of the over-current protection device 10 to cover a portion of the third electrode 26, thereby exposing the first electrode 22, the second electrode 23 and partially exposing the third electrode 26, as shown in FIG. 1C. The first electrode 22, the second electrode 23 and the third electrode 26 uncovered by the solder mask 29 serve as interfaces for surface-mounting the over-current protection device 10 to a circuit board.

Figure 1D:
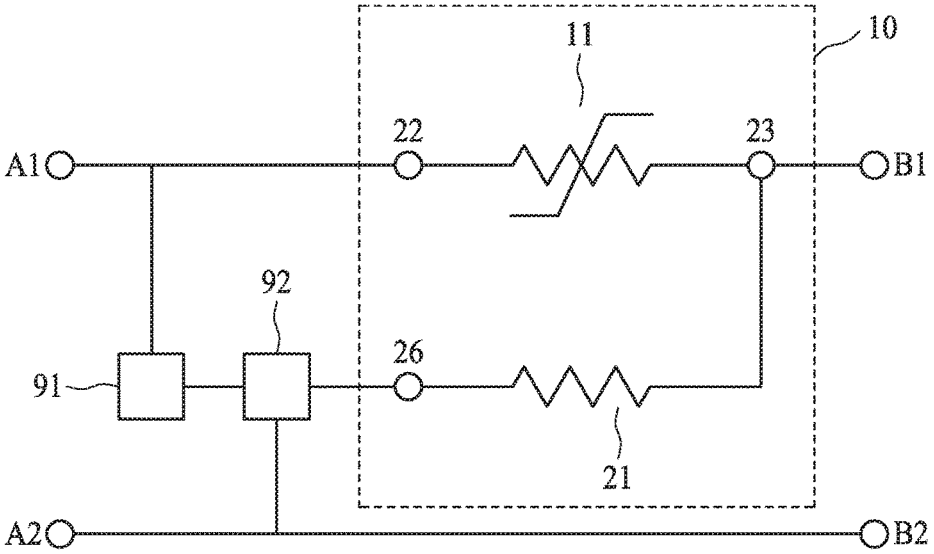
FIG. 1D shows an equivalent circuit diagram of an over-current protection device in accordance with the first embodiment of the present application.

The equivalent circuit of the over-current protection device 10 is shown in FIG. 1D. The two ends of the PTC device 11 connect to the first electrode 22 and the second electrode 23. Two ends of the heating element 21 connect to the second electrode 23 and the third electrode 26. As such, an end of the PTC device 11 and an end of the heating element 21 commonly connect to the second electrode 23. In an embodiment, the third electrode 26 may connect to a switch 92 such as a field effect transistor (FET), and the switch 92 further connects to a sensor 91 to receive signals detected. The terminals A1 and A2 may connect to circuits or apparatuses to be protected, whereas terminals B1 and B2 may connect to a power source such as a battery. In an embodiment, the sensor 91 is capable of detecting voltage drops or temperatures. If a voltage drop or a temperature reaches or exceeds a predetermined value, the switch 92 turns on to allow a current to flow through the heating element 21 to heat the PTC device 11. Accordingly, the hold current of the PTC device 11 decreases to speed up the trip of the PTC device 11.

Because the over-current protection device of low resistivity has a high hold current at a specific temperature, e.g., 80° C., it is not easily tripped. According to the present application, the heating element 21 heats the PTC device 11 to speed up the trip of the device, so as to meet the specification that the device has to trip within 60 seconds at ambient temperature of 80° C. when 8 A is applied thereto.

Figure 2A:
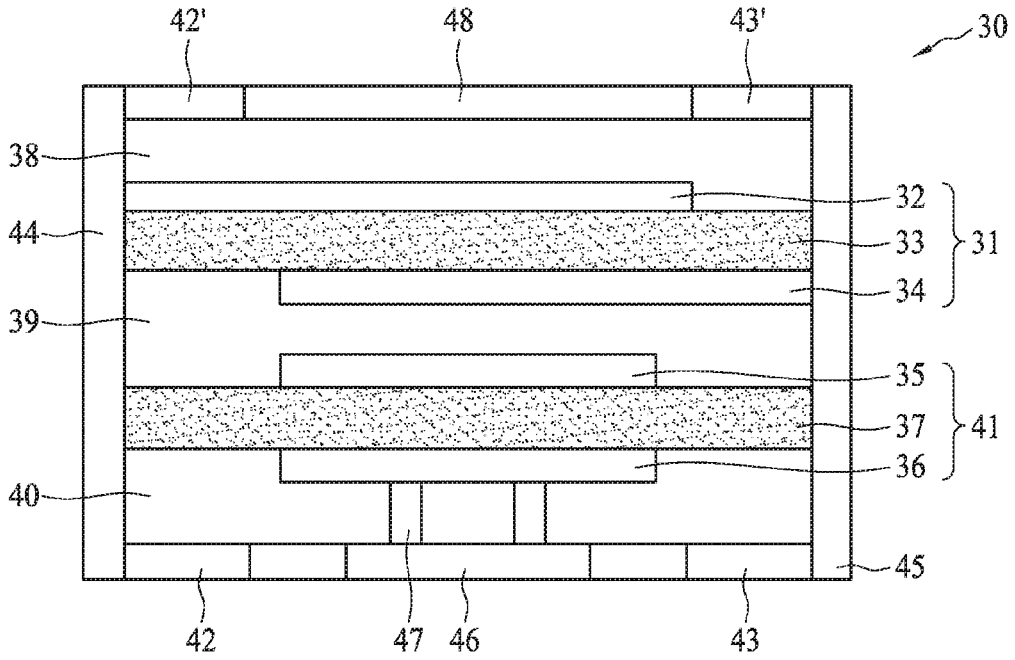
FIGS. 2A to 2D show an over-current protection device in accordance with a second embodiment of the present application.
Figure 2B:
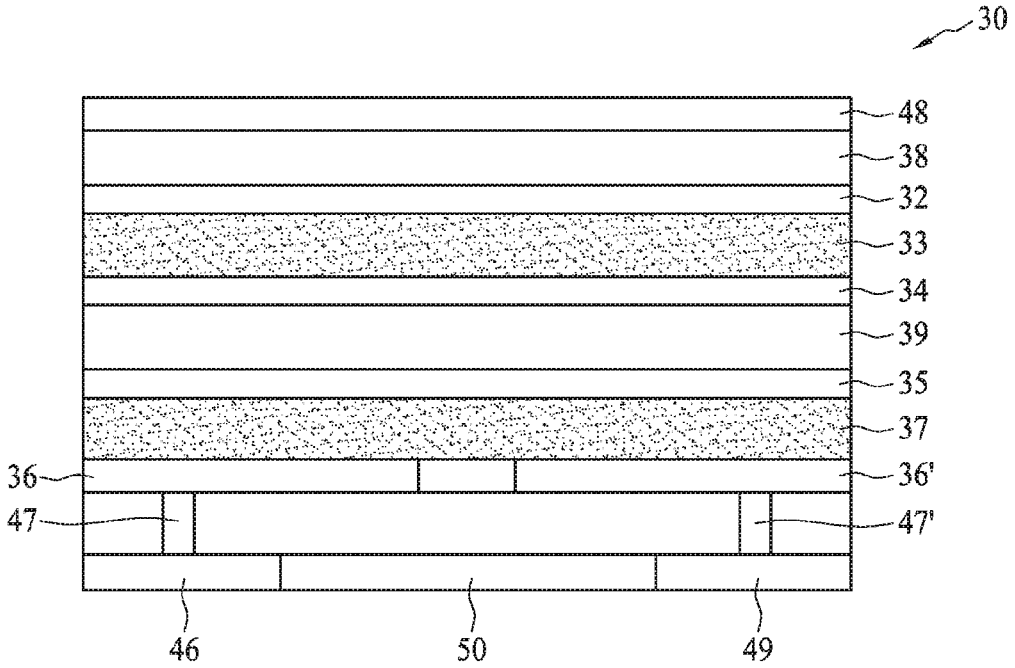
Figure 2C:
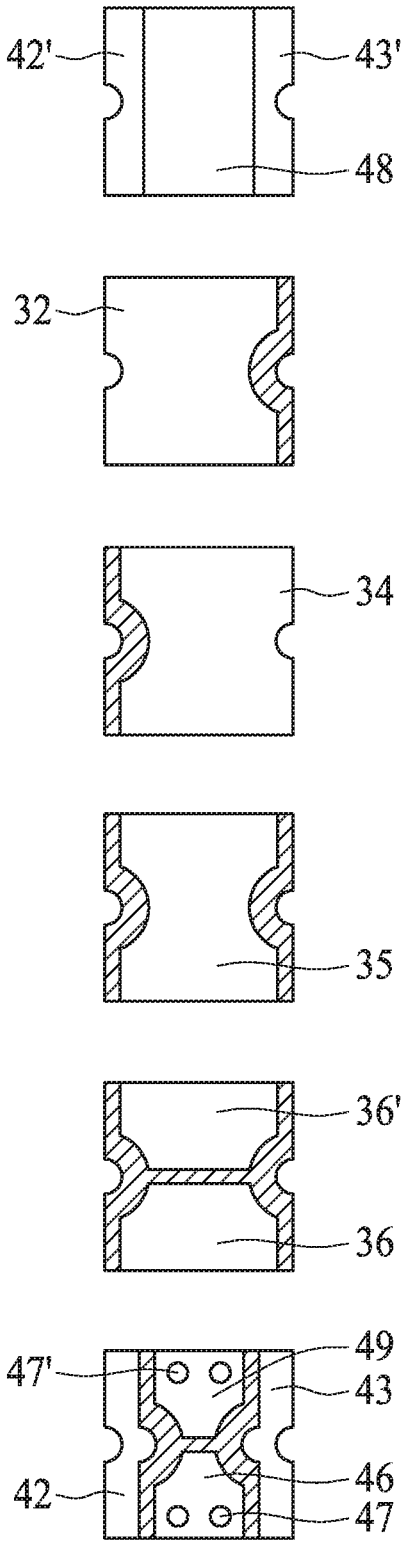

FIGS. 2A and 2B show an over-current protection device 30 in accordance with a second embodiment of the present application, which is a hexahedron that could be used for surface-mounting to a circuit substrate. FIG. 2A shows a lateral view of the over-current protection device 30 and FIG. 2B shows another lateral view of the device 30 to illustrate essential structures and conductive paths thereof. The over-current protection device 30 is a laminated structure comprising conductive layers, insulating layers and a PTC material layer extending in a horizontal direction, those layers associating with vertical conductive connecting members to form a circuitry as desired. For the ease of describing the circuitry, upper and lower surfaces of the over-current protection device 30, and individual conductive layers are shown in FIG. 2C. The shadow parts represent notches those are removed by etching in circuitry manufacturing for separation. The core of the over-current protection device 30 comprises a PTC device 31 and a heating element 41. The PTC device 31 comprises a PTC material layer 33, a first metal foil 32 and a second metal foil 34. The first metal foil 32 and the second metal foil 34 are formed on upper and lower surfaces of the PTC material layer 33, respectively. The heating element 41 may be a PTC heater or other heaters. In an embodiment, the heating element 41 comprises a heating layer 37, a first conductive layer 35, a second conductive layer 36 and a third conductive layer 36'. The first conductive layer 35 is formed on an upper surface of the heating layer 37, and the second and third conductive layers 36 and 36' are formed on a lower surface of the heating layer 37. Insulating layers 38, 39 and 40 are disposed on or between the PTC device 31 and the heating element 41, and may comprise prepreg or other insulating materials. An upper surface of the insulating layer 38 is provided with a solder mask 48, and a lower surface of the insulating layer 40 is provided with a first electrode 42, a second electrode 43, a third electrode 46 and a fourth electrode 49. The third electrode 46 and the fourth electrode 49 are disposed between the first electrode 42 and second electrode 43, and gaps are formed therebetween for separation. A separation is formed between the third electrode 46 and the fourth electrode 49. The first metal foil 32 of the PTC device 31 electrically connects to the first electrode 42 through a first conductive connecting member 44 extending in a vertical direction. The second metal foil 34 electrically connects to the second electrode 43 through a second conductive connecting member 45 extending in a vertical direction. In an embodiment, the first and second conductive connecting members 44 and 45 may be semicircular holes made by mechanical drilling followed by electroplating conductive films thereon. The first conductive layer 35 on the heating layer 37 is separated from the first and second conductive connecting members 44 and 45, and the second conductive layer 36 on the heating layer 37 is separated from the first and second conductive connecting members 44 and 45 as well. Moreover, the second conductive layer 36 is separated from the third conductive layer 36'. Accordingly, a current path from the second conductive layer 36, the heating layer 37, the first conductive layer 35, the heating layer 37 to the third conductive layer 36' is formed. This current path contains two heating resistors. That is, the heating element 41 contains two resistors in serial connection to further increase heating efficiency. The second conductive layer 36 connects to the third electrode 46 through the first conductive hole 47, and the third conductive layer 36' electrically connects to the fourth electrode 49 through the second conductive hole 47'. The first electrode 42 may further comprise an electrode 42' formed on a surface of the insulating layer 38, and the second electrode 43 may further comprise an electrode 43' formed on the insulating layer 38. The solder mask 48 is placed between electrodes 42' and 43'.

Figure 2D:
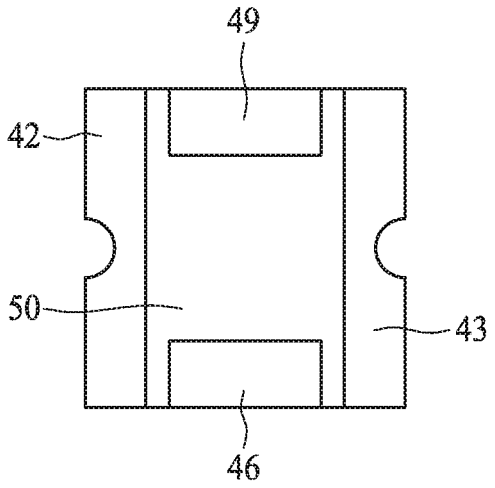

In an embodiment, a solder mask 50 may cover separations among electrodes 42, 43, 46 and 49 but still expose electrodes 42, 43, 46 and 49 as interfaces for surface-mounting to a circuit board, as shown in FIG. 2D.

Figure 2E:
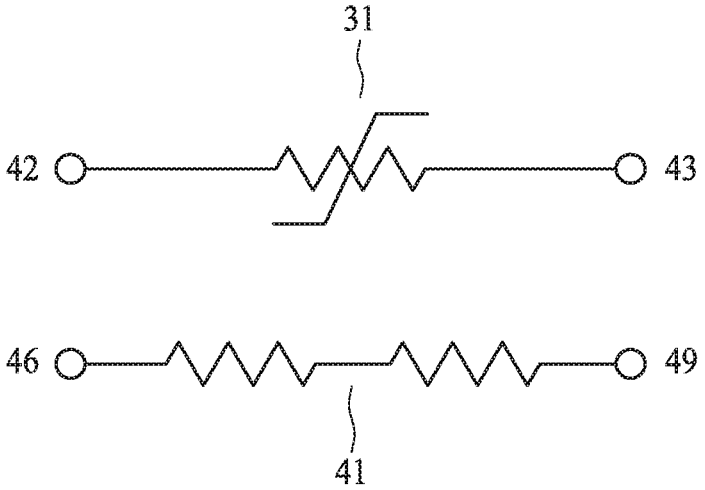
FIG. 2E show an equivalent circuit diagram of an over-current protection device in accordance with the second embodiment of the present application.

The equivalent circuit of the over-current protection device 30 of the second embodiment is depicted in FIG. 2E. In this embodiment, the heating element 41 comprises two resistors in serial connection to enhance heating efficiency. Similar to FIG. 1D, the heating element 41 may connect to a switch, upon a voltage drop or a temperature detected by a sensor, to determine whether to allow current to flow through the heating element 41 so as to enable the heating element 41 to heat and trip the PTC device 31.

Figure 3A:
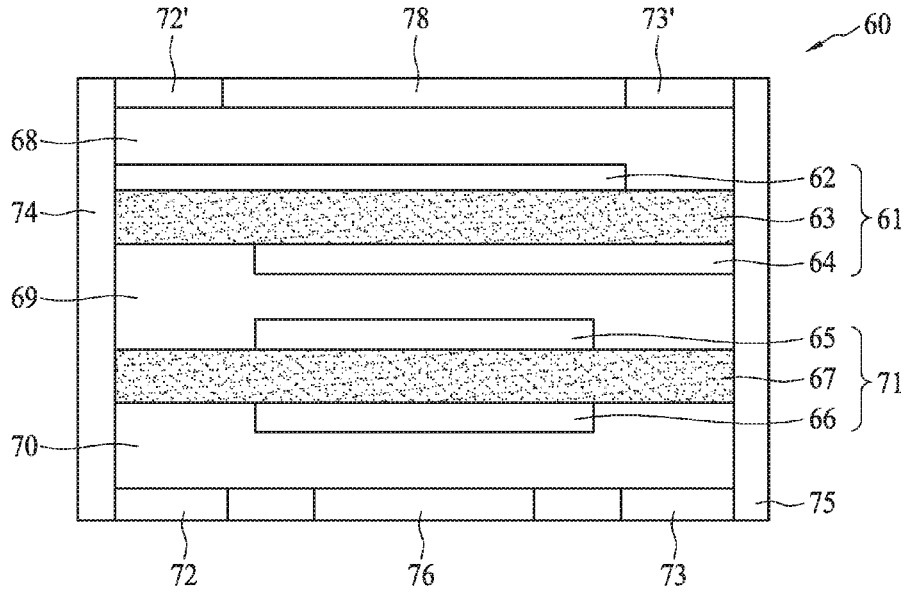
FIGS. 3A to 3C show an over-current protection device in accordance with a third embodiment of the present application.
Figure 3B:
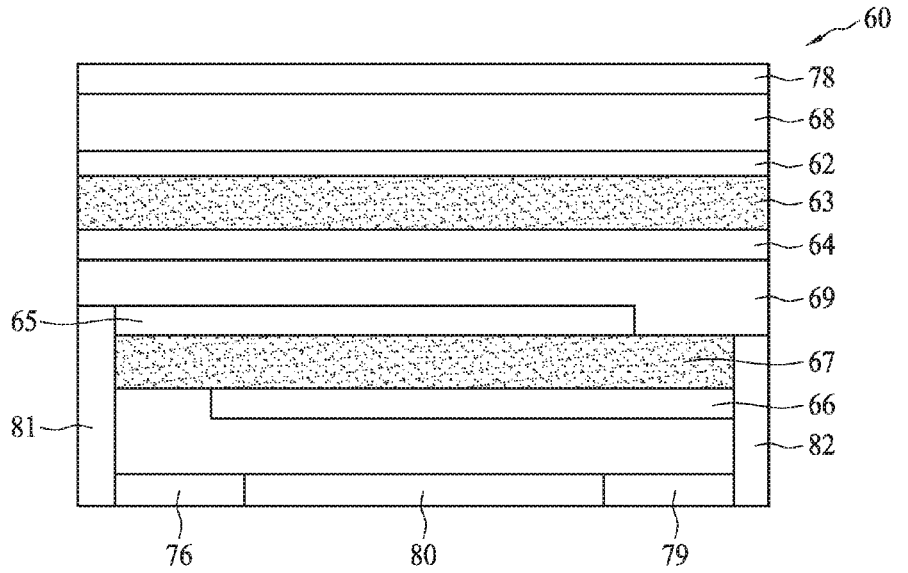
Figure 3C:
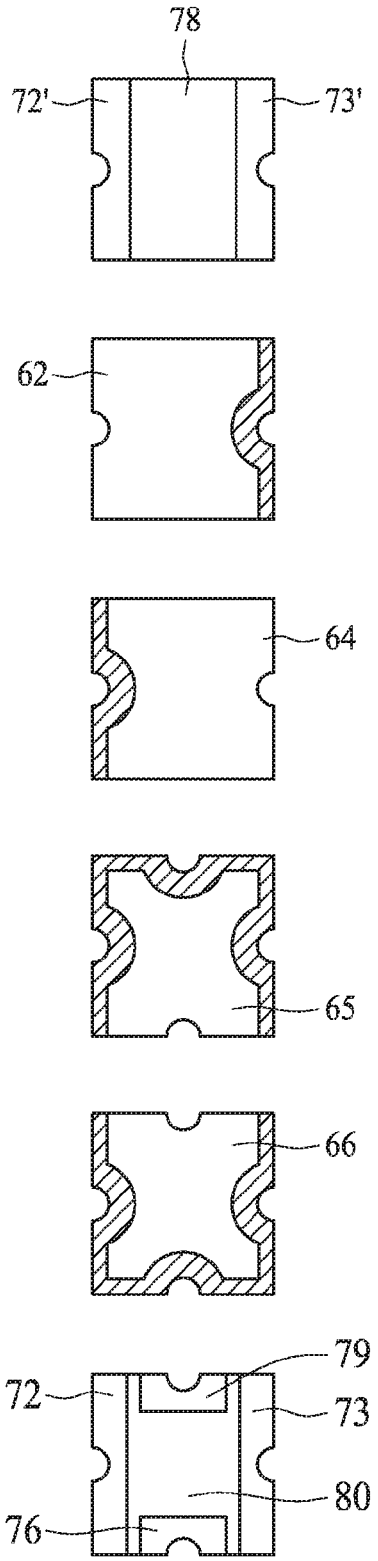

FIGS. 3A and 3B show an over-current protection device 60 in accordance with a third embodiment of the present application, which is a hexahedron that could be used for surface-mounting. FIG. 3A shows a lateral view of the over-current protection device 60 and FIG. 3B shows another lateral view of the device 60, illustrating essential structures and conductive paths thereof. The over-current protection device 60 is a laminated structure comprising conductive layers, insulating layers and a PTC material layer extending in a horizontal direction, associating with vertical conductive connecting members to form a circuitry as desired. For the ease of describing the circuitry, upper and lower surfaces of the over-current protection device 60, and individual conductive layers are shown in FIG. 3C. The shadow parts represent notches those are removed by etching in circuitry manufacturing for separation. The over-current protection device 60 essentially comprises a PTC device 61 and a heating element 71. The PTC device 61 comprises a PTC material layer 63, a first metal foil 62 and a second metal foil 64. The first metal foil 62 and the second metal foil 64 are formed on upper and lower surfaces of the PTC material layer 63, respectively. In an embodiment, the heating element 71 may be a PTC heater which comprises a heating layer 67, a first conductive layer 65 and a second conductive layer 66. The first conductive layer 65 is formed on an upper surface of the heating layer 67, and the second conductive layer 66 is formed on a lower surface of the heating layer 67. Insulating layers 68, 69 and 70 are disposed on or between the PTC device 61 and the heating element 71, and may comprise prepreg or other insulating materials. A surface of the insulating layer 68 is provided with a solder mask 78, and a lower surface of the insulating layer 70 is provided with a first electrode 72, a second electrode 73, a third electrode 76 and a fourth electrode 79. The third electrode 76 and the fourth electrode 79 are disposed between the first electrode 72 and second electrode 73, and gaps are formed therebetween for separation. A separation is formed between the third electrode 76 and the fourth electrode 79. The first metal foil 62 of the PTC device 61 electrically connects to the first electrode 72 through a first conductive connecting member 74 extending in a vertical direction. The second metal foil 64 electrically connects to the second electrode 73 through a second conductive connecting member 75 extending in a vertical direction. The first conductive layer 65 on the upper surface of the heating element 67 electrically connects to the third electrode 76 through a third conductive connecting member 81. The second conductive layer 66 on the lower surface of the heating element 67 electrically connects to the fourth electrode 79 through a fourth conductive connecting member 82. A separation is between the first conductive layer 65 and the fourth conductive connecting member 82, and a separation is between the second conductive layer 66 and the third conductive connecting member 81. Accordingly, if the third electrode 76 and the fourth electrode 79 connect to an electrical source, a current flows through the heating layer 67 to form a circuit containing a resistor. In an embodiment, the first, second, third and fourth conductive connecting members 74, 75, 81 and 82 may be semicircular holes electroplated with conductive films. The first electrode 72 may further comprise an electrode 72' formed on a surface of the insulating layer 68, and the second electrode 73 may further comprise an electrode 73' formed on the insulating layer 68. The solder mask 78 is placed between electrodes 72' and 73'. A solder mask 80 forms a part of a lower surface of the over-current protection device 60, and exposes electrodes 72, 73, 76 and 79 serving as interfaces for surface-mounting to a circuit board.

Figure 3D:
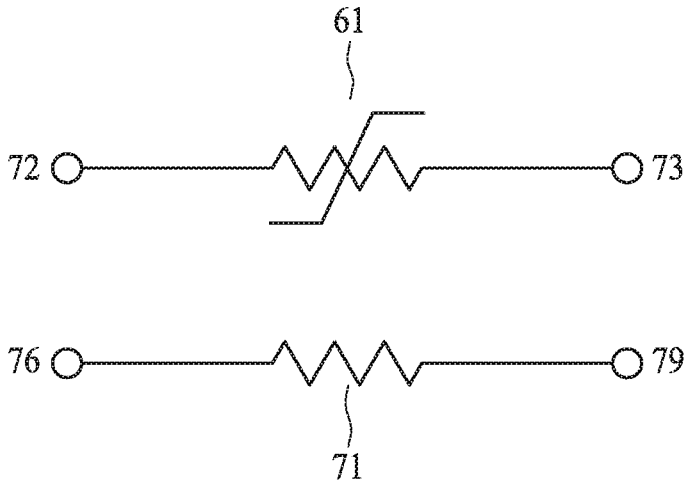
FIG. 3D shows an equivalent circuit diagram of an over-current protection device in accordance with the third embodiment of the present application.

The equivalent circuit of the over-current protection device 60 of the third embodiment is depicted in FIG. 3D. In this embodiment, the heating element 71 comprises one resistor. Similar to FIG. 1D, the heating element 71 may connect to a switch, upon a voltage drop or temperature detected by a sensor, to determine whether to allow current to flow through the heating element 71 so as to enable the heating element 71 to heat and trip the PTC device 61.

Figure 4A:
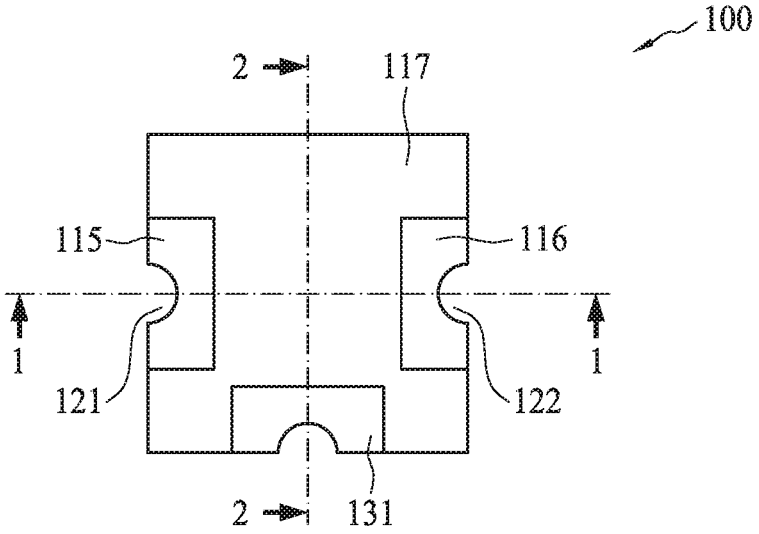
FIGS. 4A to 4C show an over-current protection device in accordance with a fourth embodiment of the present application.
Figure 4B:
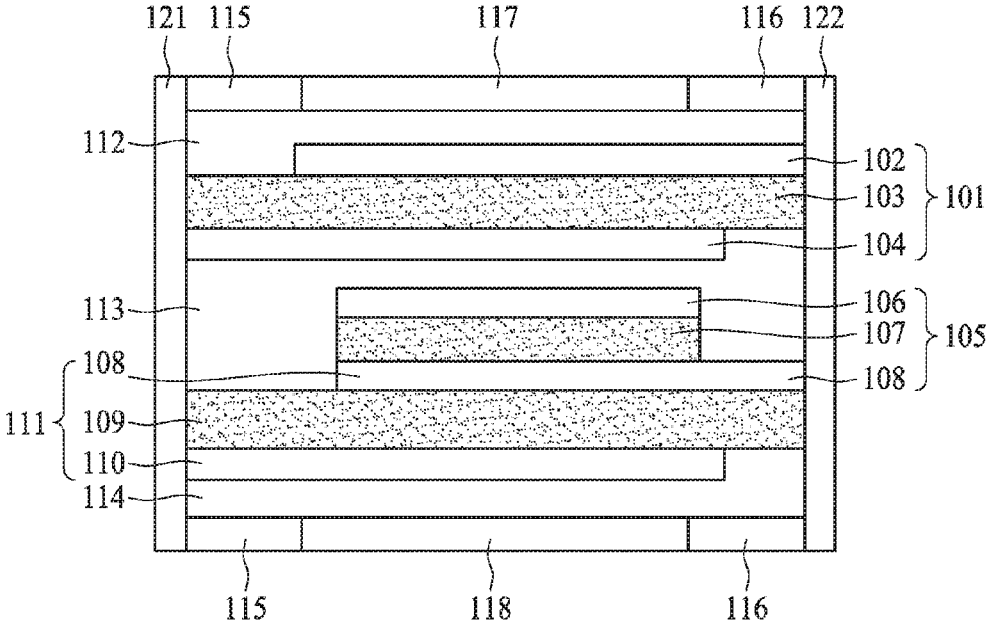
Figure 4C:
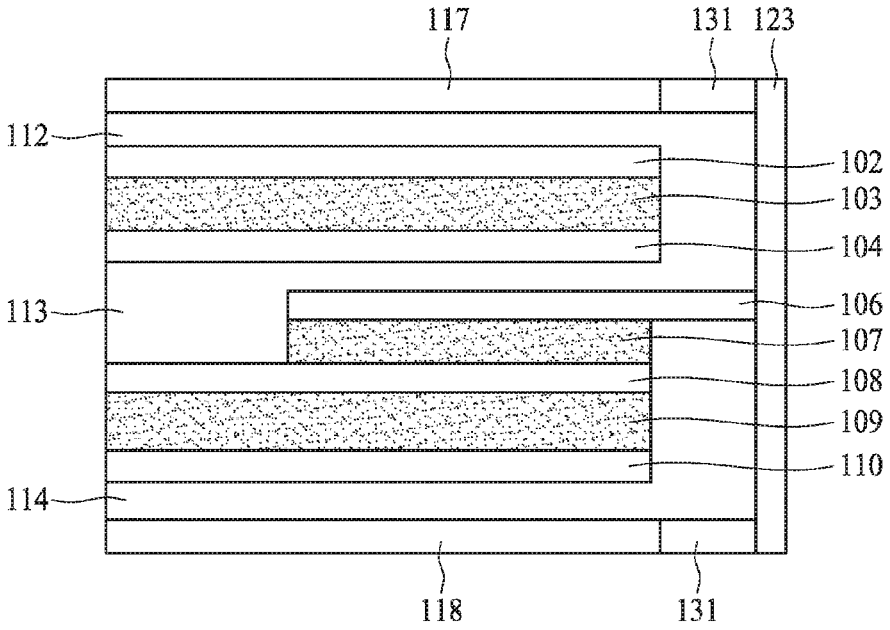
Figure 4D:
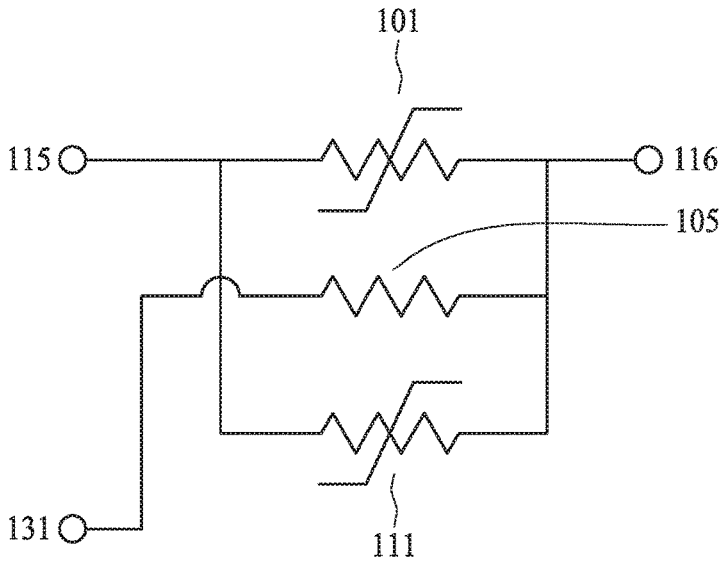
FIG. 4D shows an equivalent circuit diagram of an over-current protection device in accordance with the fourth embodiment of the present application.

FIGS. 4A to 4C show an over-current protection device 100 in accordance with a fourth embodiment of the present application. The over-current protection device 100 contains two PTC devices in parallel connection to decrease resistance thereof. FIG. 4A shows a top view of the over-current protection device 100, and FIGS. 4B and 4C show cross-sectional views along lines 1-1 and 2-2, respectively. FIG. 4D is an equivalent circuit diagram of the over-current protection device 100. The over-current protection device 100 is a laminated structure containing two PTC devices and a heating element. The over-current protection device 100 comprises a PTC device 101, a PTC device 111 and a heating element 105, and the heating element 105 is disposed between the PTC device 101 and PTC device 111. As such, the heating element 105 can heat the PTC devices 101 and 111 simultaneously. The PTC device 101 comprises a PTC material layer 103, a first metal foil 102 and a second metal foil 104. The first metal foil 102 and the second metal foil 104 are formed on upper and lower surfaces of the PTC material layer 103, respectively. The PTC device 111 comprises a PTC material layer 109, a first metal foil 108 and a second metal foil 110. The first metal foil 108 and the second metal foil 110 are formed on upper and lower surfaces of the PTC material layer 109, respectively. For separation, an insulting layer 112 is disposed on an upper surface of the PTC device 101, an insulating layer 113 is disposed between the PTC device 101 and the heating element 105, and an insulating layer 114 is disposed on a lower surface of the PTC device 111. The PTC material layers 103 and 109 may contain low-resistivity conductive filler as mentioned above to meet the requirement of low resistance of the device. In an embodiment, the heating element 105 may be a resistor, e.g., a PTC heater containing carbon black as conductive filler. The heating element 105 comprises a first conductive layer 106, the first metal foil 108 and a heating layer 107 disposed therebetween. Because the use of carbon black, the heating element 105 has a higher resistance than the PTC devices 101 and 111, and therefore it can effectively generate heat when current flows therethrough to heat the PTC devices 101 and 111 simultaneously. In this embodiment, the first metal foil 108 of the PTC device 111 also serve as a lower metal foil of the heating element 105, that is, the first metal foil 108 is a common electrode. The second metal foil 104 of the PTC device 101 and the second metal foil 110 of the PTC device 111 electrically connect to a first electrode 115 formed on upper and lower surfaces of the device 100 through a vertical conductive connecting member 121 which may be a semicircular holes plated with a conductive film. Likewise, the first metal foil 102 of the PTC device 101 and the first metal foil 108 of the PTC device 111 electrically connect to a second electrode 116 formed on upper and lower surfaces of the device 100 through a vertical conductive connecting member 122. As such, the PTC devices 101 and 111 are connected in parallel. The first conductive layer 106 of the heating element 105 electrically connects to a third electrode 131 on upper and lower surfaces of the over-current protection device 100 through a third conductive connecting member 123. The insulating layers 112 and 114 among the electrodes 115, 116 and 131 are covered by solder masks 117 and 118. As the equivalent circuit diagram shown in FIG. 4D, the over-current protection device 100 contains two PTC devices 101 and 111 in parallel connection associating with only one heating element 105. As long as the device 100 is not too thick, its resistance can be further decreased.

Test results of the over-current protection devices of the present application are shown in Table 1. The over-current protection devices of the embodiments Em 1-6 have various sizes and comprise a single PTC layer (a single PTC device), e.g., the aforementioned first embodiment, or two PTC layers, e.g., the aforementioned fourth embodiment. The data include initial resistances of the PTC devices "Ri (PTC)", initial resistances of the heating elements, "Ri (heating)," surface temperatures (° C.) of the heating elements when 6V and 1 A are applied to the device, hold currents at 60° C. when the heating elements are not activated "Ih (60° C.)", and trip currents when the heating elements are activated "It (heating)". For comparison, comparative examples Comp 1 and 2 show the test results of the over-current protection devices without heating elements. In Em 1 to Em 6, the PTC devices use titanium carbide as conductive fillers. Alternatively, tungsten carbide and nickel powder may be used. The heating elements contain carbon black. The compositions and ratio of Em 1 to Em 6 are the same. Comp 1 and Comp 2 use the same PTC material as Em 1 to Em 6, but they do not have heating elements.

TABLE 1

| | Size (mm) | Area ($mm^2$) | PTC layers | Ri (PTC) (Ω) | Ri (heating) (Ω) | Surface temp of heating element ° C. @ 6 V/1 A | Ih (60° C.) (A) | It (heating) |
|---|---|---|---|---|---|---|---|---|
| Em 1 | 4.0 × 3.0 | 12 | 1 | 0.0059 | 0.5377 | 88 | 4.5 | 0.1 A |
| Em 2 | 5.4 × 3.2 | 17.28 | 1 | 0.0039 | 0.3351 | 103 | 5.2 | 0.2 A |
| Em 3 | 9.5 × 5.0 | 47.5 | 1 | 0.0015 | 0.2835 | 83 | 8.5 | 0.2 A |
| Em 4 | 4.0 × 3.0 | 12 | 2 | 0.0032 | 0.325 | 93 | 5.4 | 0.2 A |
| Em 5 | 5.4 × 3.2 | 17.28 | 2 | 0.0022 | 0.2953 | 97 | 6.5 | 0.3 A |
| Em 6 | 9.5 × 5.0 | 47.5 | 2 | 0.0008 | 0.1072 | 83 | 9.2 | 0.3 A |
| Comp 1 | 5.4 × 3.2 | 17.28 | 1 | 0.0044 | — | — | 5.4 | 3 A@99° C. |
| Comp 2 | 5.4 × 3.2 | 17.28 | 2 | 0.0035 | — | — | 6.5 | 3 A@108° C. |

The over-current protection devices of Em 1 to Em 3 have areas of 12 $mm^2$, 17.28 $mm^2$ and 47.5 $mm^2$, respectively, and contain one PTC device. The over-current protection devices of Em 4 to Em 6 have areas of 12 $mm^2$, 17.28 $mm^2$ and 47.5 $mm^2$, respectively, and contain two PTC devices in parallel connection. Because parallel connection of two PTC devices, the initial resistance Ri (PTC) of Em 4 to Em 6 only about half those of Em 1 to Em 3 with same areas to obtain over-current protection devices of lower resistance. In Em 1 to 6, the resistances of the heating elements "Ri (heating)", e.g., 0.1-0.6Ω, are much larger than the resistances of PTC devices "Ri (PTC)", e.g., 0.0008-0.006Ω, by 50 to 70 times. The surface temperature of the heating element is about 80 to 110° C. when 6V/1 A is applied to the over-current protection devices. It appears that the heating element can effectively heat the PTC devices nearby after it is activated. It is observed that hold current at 60° C. when the heating element is not activated, i.e., "Ih (60° C.)", is large and about 4-10 A. Even if battery temperature reaches 60° C., the included over-current protection device still allows high current charging for quick charge applications. However, a small current of only 0.1-0.3 A is able to trip the over-current protection device if the heating element is activated. To the contrary, Comp 1 and 2 without heating mechanism, they need 3 A to trip the over-current protection device. In summary, the over-current protection device of the present application has the relation: It (heating)<Ih (60° C.)×10%, where Ih (60° C.) is a hold current of the over-current protection device at 60° C. when the heating element is not activated; It (heating) is a trip current of the over-current protection device when the heating element is activated to heat the PTC device. In other words, the over-current protection device of the present application can sustain high hold current at high temperatures, and only need a small current to trip so as to effectively provide over-current protection. In Comp 1 and 2, It (heating) is about 0.4 to 0.6 times Ih (60° C.). That is, it needs large current to trip the over-current protection device and may be not able to timely provide over-current protection. In Table 1, Em 1-6 comply with the relation: It (heating)<Ih (60° C.)×8%, or It (heating) <Ih (60° C.)×5%, in particular.

Because the PTC device of low resistivity has high hold current at high temperatures, it is not easily tripped. In the present application, the heating element heats the PTC device for specific situations to decrease hold current of the PTC device to induce or accelerate trip. Accordingly, the problem that the PTC device of low resistivity is not easily tripped can be resolved. The over-current protection device of the present application has the features of low resistivity, high hold current and quick trip within 60 seconds at 60° C. when 8 A is applied thereto.

The above-described embodiments of the present invention are intended to be illustrative only. Numerous alternative embodiments may be devised by persons skilled in the art without departing from the scope of the following claims.

What is claimed is:

1. An over-current protection device, comprising:

at least one PTC device comprising crystalline polymer and metal or conductive ceramic filler dispersed therein, the PTC device having a resistivity less than 0.1 Ω·cm; and at least one heating element operable to heat the PTC device;

wherein two ends of the PTC device electrically connect to a first electrode and a second electrode, two ends of the heating element electrically connect to the second electrode and a third electrode, and the first, second and third electrodes are formed at a lower surface of the over-current protection device as interfaces for surface-mounting, and wherein the over-current protection device has the relation: It (heating)<Ih (60° C.)×10%, where Ih (60° C.) is a hold current of the over-current protection device at 60° C. when the heating element is not activated; It (heating) is a trip current of the over-current protection device when the heating element is activated to heat the PTC device.

2. The over-current protection device of claim 1, wherein the heating element heats the PTC device to decrease the hold current of the PTC device to induce a trip of the PTC device.

3. The over-current protection device of claim 1, wherein the heating element has a resistance sufficient to induce a trip within 60 seconds at ambient temperature of 80° C. when a current of 8 A is applied to the PTC device.

4. The over-current protection device of claim 1, wherein the heating element has a resistance larger than or equal to 0.1Ω.

5. The over-current protection device of claim 1, wherein the heating element comprises two resistors in serial connection.

6. The over-current protection device of claim 1, wherein the crystalline polymer has a melting point larger than 150° C.

7. The over-current protection device of claim 1, wherein the heating element is a ceramic PTC heater, a polymeric PTC heater or a resistor-type heater.

8. The over-current protection device of claim 7, wherein the polymeric PTC heater comprises crystalline polymer of a melting point greater than 150° C.

9. The over-current protection device of claim 7, wherein the polymeric PTC heater comprises carbon black as conductive filler.

10. The over-current protection device of claim 1, wherein the heating element is disposed between two PTC devices, and the two PTC devices are in parallel connection.

11. The over-current protection device of claim 1, wherein the PTC device comprises a PTC material layer, a first metal foil and a second metal foil, the first metal foil is formed on an upper surface of the PTC material layer, the second metal foil is formed on a lower surface of the PTC material layer, the heating element comprises a heating layer, a first conductive layer and a second conductive layer, the first conductive layer is formed on an upper surface of the heating layer, and the second conductive layer is formed on a lower surface of the heating layer.

12. The over-current protection device of claim 11, wherein the first electrode electrically connects to the first metal foil, the second electrode electrically connects to the second metal foil and the first conductive layer, and the third electrode electrically connects to the second conductive layer.

13. The over-current protection device of claim 12, further comprising:

a first conductive connecting member extending vertically to connect to the first electrode and the first metal foil;

a second conductive connecting member extending vertically to connect to the second electrode, the second metal foil and the first conductive layer; and at least one conductive hole extending vertically to connect to the third electrode and the second conductive layer;

wherein the first and second conductive layers are separated from the first conductive connecting member.

14. An over-current protection device, comprising:

at least one PTC device comprising crystalline polymer and metal or conductive ceramic filler dispersed therein, the PTC device having a resistivity less than 0.1 Ω·cm;

at least one heating element operable to heat the PTC device; and a first electrode, a second electrode, a third electrode and a fourth electrode formed at a lower surface of the over-current protection device as interfaces for surface-mounting, wherein the PTC device comprises a PTC material layer, a first metal foil and a second metal foil, the first metal foil is formed on an upper surface of the PTC material layer, the second metal foil is formed on a lower surface of the PTC material layer, the heating element comprises a heating layer, a first conductive layer and a second conductive layer, the first conductive layer is formed on an upper surface of the heating layer, and the second conductive layer is formed on a lower surface of the heating layer, wherein the first electrode electrically connects to the first metal foil, the second electrode electrically connects to the second metal foil, the third electrode electrically connects to the first conductive layer, and the fourth electrode electrically connects to the second conductive layer, and wherein the over-current protection device has the relation: It (heating)<Ih (60° C.)×10%, where Ih (60° C.) is a hold current of the over-current protection device at 60° C. when the heating element is not activated; It (heating) is a trip current of the over-current protection device when the heating element is activated to heat the PTC device.

15. The over-current protection device of claim 14, further comprising:

a first conductive connecting member extending vertically to connect to the first electrode and the first metal foil;

a second conductive connecting member extending vertically to connect to the second electrode and the second metal foil;

a third conductive connecting member extending vertically to connect to the third electrode and the first conductive layer; and a fourth conductive connecting member extending vertically to connect to the fourth electrode and the second conductive layer;

wherein the first and second conductive layers are separated from the first and second conductive connecting members.

16. An over-current protection device, comprising:

at least one PTC device comprising crystalline polymer and metal or conductive ceramic filler dispersed therein, the PTC device having a resistivity less than 0.1 Ω·cm;

at least one heating element operable to heat the PTC device; and a first electrode, a second electrode, a third electrode and a fourth electrode formed at a lower surface of the over-current protection device as interfaces for surface-mounting, wherein the PTC device comprises a PTC material layer, a first metal foil and a second metal foil, the first metal foil is formed on an upper surface of the PTC material layer, the second metal foil is formed on a lower surface of the PTC material layer, the heating element comprises a heating layer, a first conductive layer, a second conductive layer and a third conductive layer, the first conductive layer is formed on an upper surface of the heating layer, and the second and third conductive layers are formed on a lower surface of the heating layer, wherein the first electrode electrically connects to the first metal foil, the second electrode electrically connects to the second metal foil, the third electrode electrically connects to the second conductive layer, and the fourth electrode electrically connects to the third conductive layer, and wherein the over-current protection device has the relation: It (heating)<Ih (60° C.)×10%, where Ih (60° C.) is a hold current of the over-current protection device at 60° C. when the heating element is not activated; It (heating) is a trip current of the over-current protection device when the heating element is activated to heat the PTC device.

17. The over-current protection device of claim 16, further comprising:

a first conductive connecting member extending vertically to connect to the first electrode and the first metal foil;

a second conductive connecting member extending vertically to connect to the second electrode and the second metal foil;

at least one first conductive hole extending vertically to connect to the third electrode and the second conductive layer; and at least one second conductive hole extending vertically to connect to the fourth electrode and the third conductive layer;

wherein the second conductive layer is separated from the third conductive layer, and the first, second and third conductive layers are separated from the first and second conductive connecting members.

* * * * *